United States Patent [19]

Miyazaki et al.

[11] 4,376,257

[45] Mar. 8, 1983

[54] ELECTRON GUN STRUCTURES FOR USE IN IN-LINE TYPE COLOR PICTURE TUBES

[75] Inventors: Masahiro Miyazaki; Hisao Nakamura, both of Mobara, Japan

[73] Assignee: Hitachi, Ltd., Tokyo, Japan

[21] Appl. No.: 190,727

[22] Filed: Sep. 25, 1980

[30] Foreign Application Priority Data

Jan. 23, 1980 [JP] Japan ..... 55/5799[U]

[51] Int. Cl.[3] ..... H01J 29/02; H01J 29/82

[52] U.S. Cl. ..... 313/417; 313/457

[58] Field of Search ..... 313/417, 451, 457, 456, 313/411, 447, 409

[56] References Cited

U.S. PATENT DOCUMENTS 3,351,792 11/1967 Kuryla ..... 313/451 X
3,732,450 5/1973 Mayers ..... 313/417 X
3,973,163 8/1976 Collins ..... 313/417
4,101,801 7/1978 Collins ..... 313/417

FOREIGN PATENT DOCUMENTS 44-6183 3/1969 Japan .

*Primary Examiner*—Robert Segal
*Attorney, Agent, or Firm*—Charles E. Pfund

[57] ABSTRACT

The electron gun structure comprises a cup shaped control electrode having a top provided with three aligned openings, and one ends of supporting members are secured to the outer wall of the control electrode near a lower opening. Each supporting member extends toward the top from the secured end and includes a portion separated from the outer wall. The other ends of the supporting members are embedded into insulating parts to position the control electrode with respect to other electrodes.

6 Claims, 6 Drawing Figures

ELECTRON GUN STRUCTURES FOR USE IN IN-LINE TYPE COLOR PICTURE TUBES

BACKGROUND OF THE INVENTION

This invention relates to an electron gun structure for use in an in-line type color picture tube or cathode ray tube.

An electron gun structure of this type comprises three electron guns arranged in-line that is a center gun coaxial with the tube axis and two side guns disposed on the opposite sides of the center gun, the guns emitting electron beams impinging upon three color phosphors coated on the inner surface of the face plate of the tube.

Electrodes comprising these guns and having the same functions are constructed integrally as far as possible. Usually the control electrodes, accelerating electrodes, focusing electrodes and anode electrodes constituting respective guns are constructed integrally whereas the heaters and cathode electrodes are construced independently and electrically insulated from each other.

In the electron gun structure of this type it is usual to construct such that a heater, and a cathode electrode which are independently provided for each gun, and a common control electrode $G_1$, an accelerating electrode $G_2$, a focusing electrode, and an anode electrode which are commonly provided for each gun are disposed in a predetermined order and that these elements are integrally supported by such insulating members as beads. The positional relationship between the cathode electrode and the control electrode plays an important roll in determining various characteristics of a color picture tube. For example, the spacing between the cathode electrode and the control electrode has a direct influence upon the cut-off voltage characteristic of the color picture tube such that the rise in the heating temperature of the cathode electrode causes the cathode current characteristics becomes unbalance among respective guns.

A solution of this problem is disclosed in Japanese Patent Publication No. 6183 of 1969 corresponding to Dutch Patent Application No. 65 13,665 filed on Oct. 22, 1965 wherein the control electrode has a cup shape into which the heater and the cathode electrode are snugly inserted so as to support the control electrode by an insulating member such as a bead together with other electrodes thus maintaining the control electrode and the cathode electrode in a fixed positional relationship.

Although such supporting construction can solve the aforementioned problem to some extent, there are the following problems to be solved.

More particularly, when predetermined voltages are applied to respective electrodes to operate the electron guns, as the time elapse, the control electrode is gradually heated by the heat of the heater with the result that the control electrode undergoes thermal expansion to depart from the cathode electrode. However, in an electron gun structure utilizing a cup shaped control electrode, one end of the bead support is secured to the other wall near the top of the control electrode so that the top surface of the control electrode does not deform uniformly. In other words, the top surface of the control electrode undergoes a minimum deformation near the side surface to which one end of the bead support is secured whereas the central portion of the top surface remote from the side surface undergoes a maximum deformation. Consequently, the central portion of the top surface of the control electrode most remote from the cathode electrode deforms into a convex form. As the control electrodes of the side guns are disposed on the opposite sides of the center gun and spaced apart from each other, they deform substantially in the same extent as the side wall of the control electrode to which the one end of the bead support is secured.

As is well known in the art there is the following relation among the spacing $l_1$ between the cathode electrode and the control electrode $G_1$ of an electron gun, the thickness $l_2$ of the top surface of the control electrode $G_1$, the spacing $l_3$ between the top surface of the control electrode $G_1$ and an accelerating electrode $G_2$ confronting thereto, the opening diameter D of the control electrode $G_1$, and the cut-off voltage $E_{KCO}$ of an electron beam.

$$E_{KCO}=K\,D/l_1\times l_2\times l_3\times E_{c2} \quad (1)$$

where K is a proportionally constant, and $E_{C2}$ is a voltage impressed upon the accelerating electrode $G_2$.

Under these conditions, assume now that only the spacing $l_1$ increases, the cut-off voltages $E_{KCO}$ would decrease as equation (1) teaches. In the operation of a conventional color picture tube, if only the cut-off voltage $E_{KCO}$ decreases while the control electrode is supplied with zero volt and the cathode electrode is biased positively, also the beam current $I_K$ would decrease. Thus, the beam current $I_K$ decreases as the spacing $l_1$ increases. Thus, difference in the spacings between the control electrodes and the cathode electrodes of the central and side guns causes difference in the beam current $I_K$ of respective guns thus degrating the white color balance.

Even when the beam current $I_K$ is compensated for suitably designing the circuit, the following problem still remains.

FIG. 1 of the accompanying drawing shows one example of the transient characteristics of the beam current that is the cathode current of a prior art electron gun of a color picture tube.

When the beam current $I_K$ is set to a constant value $I_{KO}$ after the electrode gun has reached a sufficiently stable operating state (at a time $t_2$), then the operation of the electron gun is stopped, the gun is cooled completely and thereafter operated again the beam current $I_K$ manifests transient characteristics as shown in FIG. 1, in which the ordinate respects the beam current $I_K$ and the abscissa the time. Curve I shows the transient chracteristic of the center gun and curve II that of the side guns.

As above pointed out, when the spacing $l_1$ gradually increases due to the thermal expansion of the control electrode, as curves I and II show, the beam current $I_K$ gradually decreases towards the stable value at time $t_2$ after building up to a maximum value at time $t_1$. Also in the prior art electron gun structure, as the spacing $l_1$ of the side guns varies greatly than that of the center gun as above described, the decrease in the beam current $I_K$ of the center gun is larger as can be noted from curve I so that when the beam currents $I_K$ of the center and side guns are adjusted to be the same at time $t_2$, at time $t_1$ the beam current $I_K$ of the center gun would be larger than those of the side guns. When the electron gun structure of the color picture tube is constructed to have such $I_K$ transient characteristics, even when the beam currents $I_K$ of respective guns were adjusted such that the image on the fluorescent screen of the tube will be white, the white color balance of the tube would be impared at the time of starting the operation of the tube whereby unwanted colors appear.

SUMMARY OF THE INVENTION

Accordingly, it is a principal object of this invention to provide an improved electron gun structure for use in an in-line type color picture tube which can prevent a unbalance between the electrical characteristics of the center and side guns even when the control electrode is locally deformed due to the heat from the heater.

Another object of this invention is to provide an improved electron gun structure for use in an in-line type color picture tube capable of minimizing the displacement of the control electrode toward the accelerating electrode so as to decrease the peak value of the cathode current at the time of starting the operation of the tube.

Still another object of this invention is to provide an electron gun structure for use in an in-line type color picture tube capable of decreasing color unbalance.

According to this invention, there is provided an electron gun structure for use in an in-line type color picture tube comprising a center gun, and a pair of side guns disposed on both sides of said center gun; each of said guns including a cathode electrode, a control electrode, and other electrodes; said control electrodes of said guns being formed in a common control electrode taking the form of a cup with a top having openings transmitting electron beams; said common control electrode being supported by supporting members; one end of each supporting member being secured to a side wall of said common control electrode at a point near lower opening of said common control electrode; each supporting member including a portion extending from said portion toward said top with a gap between said portion and the side wall of said control electrode, and a leg secured to an insulating bar so that said control electrode is supported by said insulating bar at a predetermined positional relation with respect to other electrode of each gun; each of said cathode electrodes supported by an insulating member so as to face said top openings of said common control elecrode with a predetermined spacing.

DESCRIPTION OF THE PREFERRED EMBODIMENTS

Figure 1:
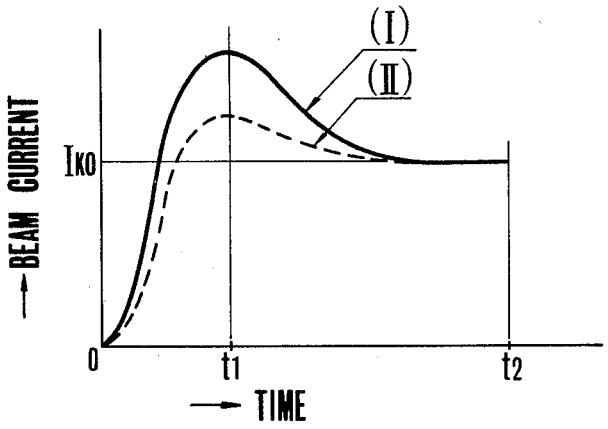
FIG. 1 is a graph showing beam current or cathode current characteristics of a prior art electron gun structure of an in-line type color picture tube.
Figure 2:
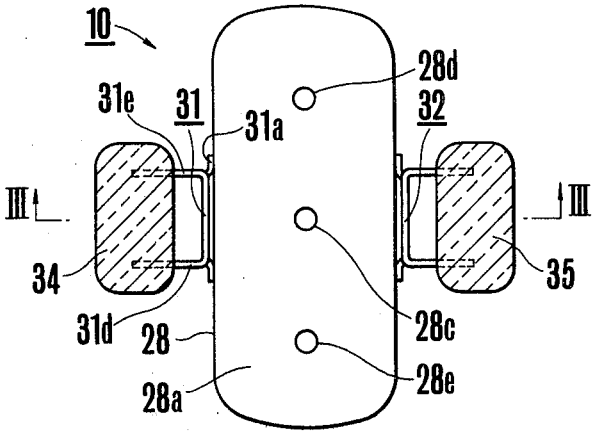
FIG. 2 is a plan view showing one example of the control electrode of an electron gun structure embodying the invention for use in an in-line type color picture tube.
Figure 3:
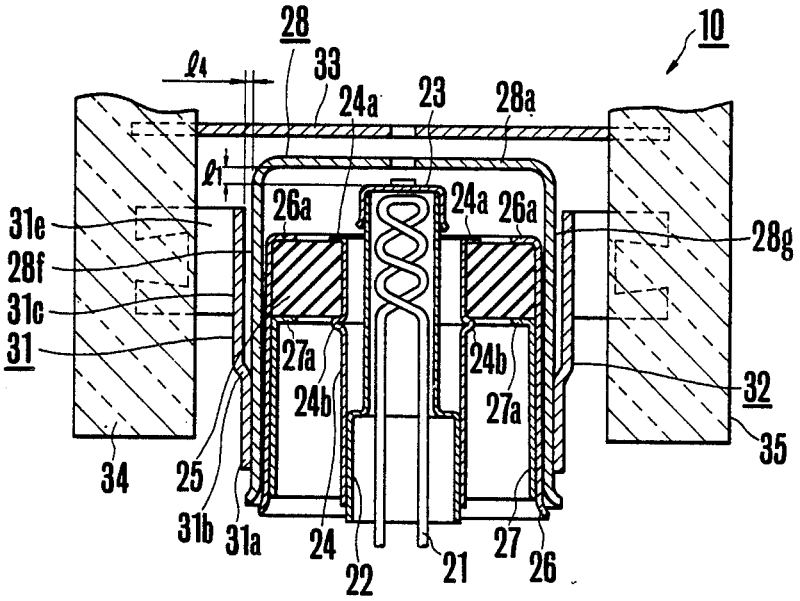
FIG. 3 is a sectional view taken along a line III—III in FIG. 2.

A preferred embodiment of the electron structure 10 shown in FIGS. 2 and 3 is of the indirectly heated cathode electrode type comprising a heater 21, a stepped sleeve 22 surrounding the heater 21 and made of nichrome or the like and a cup shaped cathode electrode 23 made of nickel, for example, the surface of the nickel electrode being coated with an oxide. The cathode electrode 23 is incorporated into a cup shaped grid electrode 28 by a first cylindrical support 24 made of stainless steel and welded to the larger diameter portion of the sleeve 22, an insulating member 25 provided with a central opening, for receiving the sleeve, the outwardly projecting flanges 24*a* and 24*b* of the sleeve 24 supporting the insulating member 25 (although not shown, the insulating member 25 is supported by the supporting member of side guns) and second and third stainless supporting member 26 and 27 for clamping the outer edges of the insulating member 25 with inwardly projecting flanges 26*a* and 27*b* on the upper ends of the supporting members 26 and 27 which are secured to the control electrode 28 by suitable means. The control electrode 28 has a rectangular shape with four corners rounded and with its top portion 28*a* faced to the cathode electrode 28 with a predetermined spacing $l_1$. As shown in FIG. 2, the top portion is provided with 3 aligned openings 28*c*, 28*d* and 28*c* spaced apart a predetermined spacing, the center opening 28*c* being aligned with the tube axis. In accordance with this invention, bead supports 31 and 32 are welded to the opposite outer side surfaces 28*f* and 28*g* of the control grid 28 as will be described later in more detail. The legs of these supports 31 and 32 are embedded in bar shaped insulating beads 34 and 35 so as to maintain a suitable positional relation with respect to another electrode, for example an accelerating electrode 33. Both bead supports 31 and 32 have the same construction so that only one of them 31 will be described. The bead support 31 is made of resilient material such as stainless steel and comprises a tongue 31*a* welded to the outer wall of the control electrode 38 near its lower opening, a parallel portion 31*c* connected to the tongue 31*a* through a shoulder 31*b* and extending toward the accelerating electrode 33*a* in parallel with the outer wall 28*f* of the control electrode 28 with a gap therebetween, and legs 31*d* and 31*e* on the opposite sides of the parallel portion 31*c* and embedded in the bead 34. Accordingly, a gap $l_4$ is left between the side surface 28*f* of the control electrode 28 and the bead support 31 except the tongue 31*a* secured to the control electrode.

Preferably the width of the gap $l_4$ is larger than 0.1 mm. With this construction, when the grid electrode 28 is heated by the heat generated by the heater, the control electrode 28 undergoes thermal expansion starting from a point near its lower opening and sufficiently spaced from the top 28*a*, at which the tongues of the bead support 31 is secured. Accordingly, the top portion 28*a* and portions nearby undergo uniform thermal expansion. Although the outer wall of the control electrode expands radially outward, since the parallel portions of the bead supports 31 and 32 oppose the outer wall of the control electrode with definite spacings there is no fear of contact of the bead supports and the outer wall of the control electrode due to thermal expansion. Consequently, the control electrode 28 always expands and contracts with points at which the tongues are secured to act as the reference points. This eliminates the difficulty of the prior art construction in which the top portion of the control electrode deforms locally causing the distance between the control electrode and the cathode electrode of the center gun to become larger than the distance between the control electrodes and the cathode electrodes of the side guns on the opposite sides of the center gun. This can prevent unbalance of electrical characteristics of respective guns caused by thermal expansion which has been inevitable with the prior art construction. As above described since various portions of the control electrode undergo uniform thermal expansion the displacement of the top portion of the control electrode toward the accelerating electrode is smaller than that of the prior art construction so that it is possible to decrease the peak of the beam current, or the cathode current at the time of starting the operation of the tube.

Figure 4:
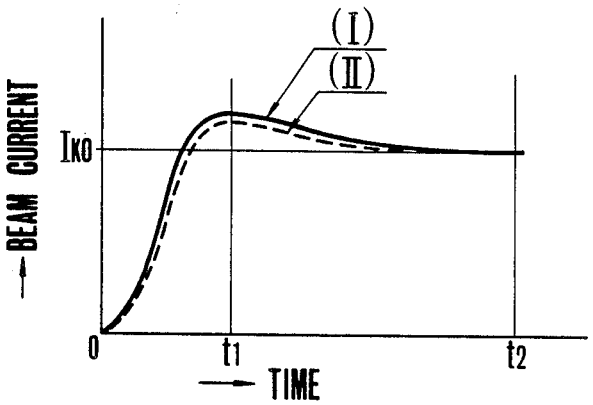
FIG. 4 is a graph showing beam current or cathode current characteristics of the electron gun structure shown in FIG. 3 and FIGS. 5 and 6 are side views showing other modifications of this invention.

FIG. 4 shows the transient characteristics of the cathode or beam current of the electron gun structure of this invention in which curve I shows the transient characteristic of the center gun and curve II those of side guns. As shown, the beam current $I_K$ transient characteristic I and II of the center and side guns substantially coincide with each other and the difference in the peak values of the beam current at the time of start is very small. Consequently, it is possible to obtain an electron gun structure having extremely small white color unbalance at the time of starting of the tube.

Figure 5:
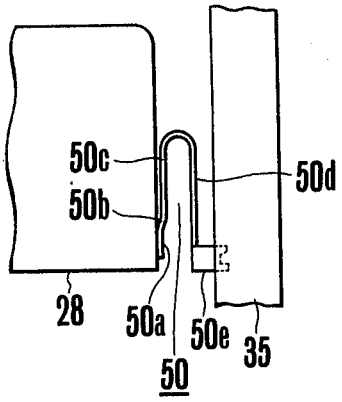

FIG. 5 shows a modification of the electron gun structure embodying the invention in which a bead support 50 is made of such resilient material as stainless steel and takes the form of a U including two parallel legs 50*c* and 50*d* both extending in parallel with the side wall of the control electrodes 28 and a bead 35 with gaps, the outer end 50*e* of the leg 50*d* being embedded in the bead 35 while the lower end of the leg 50*c* being bent toward the control electrode as at 50*b* to form a tongue 50*a*.

Again, since the tongues of the bead support 50 are secured to the side walls of the control electrode neat its lower opening, the same advantageous effect as the foregoing embodiment can be obtained.

Figure 6:
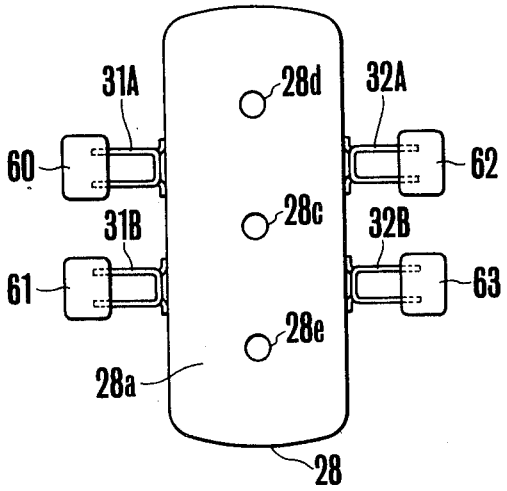

FIG. 6 shows still another modification of this invention. Although in the foregoing embodiments, the control electrode was supported at one point on both side thereof, in this embodiment the control electrode 28 is supported at two portions along respective longer sides by beads 60–63 through bead supports 31A, 31B, 32A, and 32B having the same construction as the bead supports shown in FIG. 3. or the bead support 50 shown in FIG. 5. I this modification, the tongues of the bead supports are secured to the side walls of the control electrode near its lower opening between center opening 28*c* and one side opening 28*d* and between the center opening 28*c* and the other side opening 28*e*.

It should be understood that the invention is not limited to the foregoing embodiments and that many changes and modifications will be obvious to those skilled in the art. For example, a direct heating type cathode electrode may be substituted for the illustrated indirectly heated type cathode electrode.

Although in the foregoing embodiment one leg of the bead supports has a tongue secured to the outer wall of the control electrode and a parallel portion extending in parallel with the side wall of the control electrode with a gap therebetween, any construction of the bead support can be used so long as when the control electrode undergoes thermal expansion it can expand and contract without touching the bead support. For this reason, the bead support may be shaped such that it gradually departs from the side wall of the control electrode toward the acceleration electrode starting from the tongue.

What is claimed is:

1. An electron gun structure for use in an in-line type color picture tube comprising a center gun, and a pair of side guns disposed on both sides of sid center gun; each of said guns including a cathode electrode, a control electrode, and other electrodes; said control electrodes of said guns being formed in a common control electrode taking the form of a cup with a top having openings transmitting electron beams; said common control electrode being supported by supporting members; one end of each supporting member being secured to a side wall of said common control electrode at a point near lower opening of said common control electrode; each supporting member including a portion extending from said portion toward said top with a gap between said portion and the side wall of said control electrode, and a leg secured to an insulating bar so that said control electrode is supported by said insulating bar at a predetermined positional relation with respect to other electrode of each gun; each of said cathode electrodes supported by an insulating member so as to face said top openings of said common control electrode with a predetermined spacing.

2. The electron gun structure according to claim 1 wherein said portion extending from the one end toward the top of said common control electrode comprises a first portion secured to the side wall of said common control electrode and a second portion offset from said first portion to extend in parallel along the outer surface of said common control electrode with a predetermined spacing therebetween.

3. The electron gun structure according to claim 2 wherein an upper end of said second portion is connected to said leg secured to said insulating bar.

4. The electron gun assembly according to claim 1 wherein each supporting member has a U shape, one end of one leg of the U shaped supporting member is secured to the outer wall of said common control electrode, the other portion of said one leg is offset to extend toward the top of said common control electrode in parallel with the side wall thereof with a predetermined gap therebetween.

5. The electron gun according to claim 1 wherein said supporting member are provided at least two, the top of said common control electrode is rectangular with rounded corners, one end of said supporting member is secured to two opposite longer side walls of said control electrode.

6. The electron gun structure according to claim 5 wherein a plurality of said supporting members are secured to each longer side of said top.

* * * * *

UNITED STATES PATENT AND TRADEMARK OFFICE

CERTIFICATE OF CORRECTION

PATENT NO. : 4,376,257

DATED : March 8, 1983

INVENTOR(S) : Masahiro Miyazaki and Hisao Nakamura

It is certified that error appears in the above—identified patent and that said Letters Patent is hereby corrected as shown below:

Column 1, lines 20-21, change "construced" to --constructed--

Column 1, line 61, change "other" to --outer--

Column 2, line 43, change "electrode gun" to --electron gun--

Column 5, line 35, change "neat" to --near--

Column 5, line 46, change "I" to --In--

Column 6, line 11, change "sid" to --said--

Signed and Sealed this

*Second* Day of *August 1983*

[SEAL]

*Attest:*

GERALD J. MOSSINGHOFF

*Attesting Officer*

*Commissioner of Patents and Trademarks*